US007176641B2

(12) United States Patent
Komiya et al.

(10) Patent No.: US 7,176,641 B2
(45) Date of Patent: Feb. 13, 2007

(54) CATHODE RAY TUBE

(75) Inventors: Toshifumi Komiya, Mobara (JP); Sachio Koizumi, Mobara (JP)

(73) Assignee: Hitachi Displays, Ltd., Chiba (JP)

( * ) Notice: Subject to any disclaimer, the term of this patent is extended or adjusted under 35 U.S.C. 154(b) by 9 days.

(21) Appl. No.: 11/153,830

(22) Filed: Jun. 15, 2005

(65) Prior Publication Data

US 2005/0285498 A1 Dec. 29, 2005

(30) Foreign Application Priority Data

Jun. 28, 2004 (JP) ..... 2004-189422

(51) Int. Cl.
*H01J 29/70* (2006.01)

(52) U.S. Cl. ..... 315/401; 315/5.22; 315/5.23; 313/33; 313/47

(58) Field of Classification Search ..... 315/5.22, 315/5.23, 368.25, 368.26, 401, 399, 382.1; 313/440, 414, 415, 33, 46, 30–47
See application file for complete search history.

(56) References Cited

U.S. PATENT DOCUMENTS 6,492,768 B1 * 12/2002 Koizumi et al. ..... 313/446
6,552,479 B2 * 4/2003 Komiya et al. ..... 313/337
2006/0145586 A1 * 7/2006 Yamagishi ..... 313/337

* cited by examiner

*Primary Examiner*—Hoang V. Nguyen
*Assistant Examiner*—Dieu Hien Duong
(74) *Attorney, Agent, or Firm*—Milbank, Tweed, Hadley & McCloy, LLP

(57) ABSTRACT

A heat generating portion of a heater which is incorporated in an indirectly heated cathode structure of an electron gun for a cathode ray tube is formed by joining a first winding portion and a second winding portion which differ in the number of coil winding layers and by twisting and winding a joined body in a double helical structure. The present invention allows a cathode temperature to have a high temperature and hence, it is possible to enhance the electron irradiation characteristics even when a degree of in-tube vacuum is lowered.

6 Claims, 7 Drawing Sheets

CATHODE RAY TUBE

BACKGROUND OF THE INVENTION

The present invention relates to a cathode ray tube provided with an electron gun which includes an indirectly heated cathode, and more particularly to a cathode ray tube which enhances the elevation of a cathode temperature of an indirectly heated cathode.

The cathode ray tube which is used in a television receiver set, a display tube and the like possesses the image reproducibility with high definition and hence, the cathode ray tube has been popularly used as a display means applicable to various information processing equipment. This type of cathode ray tube includes an evacuated envelope which is constituted of a panel portion which forms a phosphor screen to which phosphor is coated on an inner surface thereof, a neck portion which accommodates an electrode gun having a plurality of electrodes which are constituted of an indirectly heated cathode, a control electrode and an accelerating electrode for focusing, accelerating and allowing electron beams which are generated by an electron beam generating portion to be irradiated to the phosphor screen, and a funnel portion which contiguously connects the panel portion and the neck portion and exteriorly mounts a deflection yoke for scanning electron beams irradiated from the electron gun on the phosphor screen thereon.

As a heater which is used in the cathode ray tube having the above-mentioned constitution, a heater having the constitution disclosed in Japanese Laid-open 2002-93335 (patent literature 1 U.S. Pat. No. 6,552,479), for example, has been known and one example of such a constitution is shown in FIG. 8 and FIG. 9. Here, FIG. 8 is a side view of the heater and FIG. 9 is an enlarged view of an essential part in FIG. 8.

In FIG. 8 and FIG. 9, numeral 31 indicates a heat-generating core-wire such as a tungsten line, for example, or the like, numeral 32 indicates an alumina insulation film, numeral 33 indicates a dark alumina coated film, numeral 35 indicates a heater, numeral 351 indicates a heat generating portion of the heater 35, numeral 352 indicates a leg portion of the heater 35, numeral 353 indicates a welding portion of the heater 35, and numeral 356 indicates a top portion of the heater 35.

The heater 35 shown in FIG. 8 and FIG. 9 is constituted of the heat generating portion 351 which is formed in a double helical shape by winding the heat-generating core-wire 31 as a coil into the helical structure having a single layer at a given pitch and, thereafter, folding, twisting and winding an approximately center portion of the coil winding portion, straight portions 355 which are formed by winding the heat generating core-wire 31 into the helical structure having a single layer at a pitch equal to the pitch of the heat generating core-wire 31, and leg portions 352 which are contiguously formed with the straight portions 355 and are spirally formed by winding the heat generating core-wire 31 into a coil winding having a plurality of layers such as a five-layered (fivefold) at a pitch coarser than the pitch of the heat generating part 351, and the welding portion 353.

A remaining portion of the coil winding having such a constitution is covered with the alumina insulation film 32 except for the welding portion 353 and, further, the dark alumina coated film 33 containing tungsten fine powder is applied to a surface of the alumina insulation film 32 for performing blackening treatment.

On the other hand, Japanese Patent Laid-open 2002-25422 (patent literature 2) discloses the following constitution. First of all, a primary fine-pitch core-wire coil which leads to a heater main portion is wound at a pitch twice as large as a diameter of the core-wire. Next, the core-wire is folded back and a secondary coarse-pitch core-wire coil having a coarse pitch nine times or more as large as the fine coil pitch is wound thus forming a double winding portion. Further, using the same core-wire, a third fine-pitch core-wire coil is formed at a pitch equal to the pitch of the above-mentioned primary fine pitch, wherein both fine-pitch core-wire coils form single fine winding portions which bite in valleys respectively. Due to the above-mentioned constitution, it is possible to provide an indirectly heated electron tube heater which possesses a large mechanical strength at an end portion thereof, exhibits the low heat generation and can be easily formed.

In this specification, hereinafter, the number (X) of coil winding layers is also referred to as "X-fold winding", "X-layer winding" or "X-layer structure".

SUMMARY OF THE INVENTION

Recently, a demand for the reduction of a manufacturing cost of a cathode ray tube per se is strong and hence, it is necessary to shorten a manufacturing time to meet such a demand and the degree of in-tube vacuum is liable to be lowered due to such shortening of the manufacturing time. In spite of such lowering of the degree of vacuum, to ensure the normal electron irradiation characteristics, it is indispensable to elevate a cathode temperature under low electric power.

On the other hand, although the above-mentioned heater is excellent in realizing the lowering of the electric power, the enhancement of a mechanical strength and the like, with only the constitution which simply provides a multiple coil winding to the leg portion side, there exists a limit with respect to the elevation of the cathode temperature and hence, a further improvement is requested. Particularly, an improvement of a low power type heater which has a heater voltage of 6.3V and a heater current of 330 mA is strongly requested.

It is an object of the invention to provide a cathode ray tube provided with an indirectly heated cathode structure which uses a heater having characteristics such as the low electric power and the improved welding operability and can increase the temperature of a heat generating portion of the heater thus realizing a cathode temperature capable of ensuring normal electron irradiation characteristics.

According to a typical constitution of the invention, a heater which is incorporated in an indirectly heated cathode structure which constitutes an electron beam generating portion of an electron gun used in a cathode ray tube includes a heat generating portion which is formed by folding, twisting and winding a heat generating core-wire which is formed as a coil, a leg portion which is contiguously connected with heat generating portion and is constituted of a plurality of coil winding layers, and a welding portion which has one end thereof contiguously connected with one leg portion and the vicinity of another end thereof welded to a heater support, wherein an insulation film is applied to a portion of the heat generating portion and the leg portion except for the welding portion to the heater support, and the heat generating portion includes a plurality of winding portions which differ in the number of coil winding layers.

The invention is not limited to the above-mentioned structure and various modifications are conceivable without departing from the technical concept of the invention described in claims.

According to the invention, with the addition of multiple winding portion in the inside of the heat generating portion of the heater, it is possible to elevate the cathode temperature to a required high temperature to obtain the desired electron irradiation characteristics with only the constitution of the specification of the coil winding without necessitating the change of the basic manufacturing facilities. Accordingly, the invention can obtain large advantageous effects with respect to the mass production and the cost.

According to the invention, in the heat generating portion of the heater, by setting the number of coil winding layers of the portion which has the large number of coil winding layers twice or more as large as the number of coil winding layers of a remaining portion, it is possible to enhance the temperature elevation efficiency of the heat generating portion of the heater.

Further, according to the invention, the cathode temperature can be easily controlled and hence, it is also possible to obtain large advantageous effects with respect to the mass production and the cost.

Still further, according to the invention, since the heat generating portion is concentrated on the narrow portion, it is possible to efficiently heat the cathode.

DESCRIPTION OF PREFERRED EMBODIMENTS

Hereinafter, embodiments of the invention are explained in detail in conjunction with drawings showing the embodiments.

[Embodiment 1]

Figure 1:
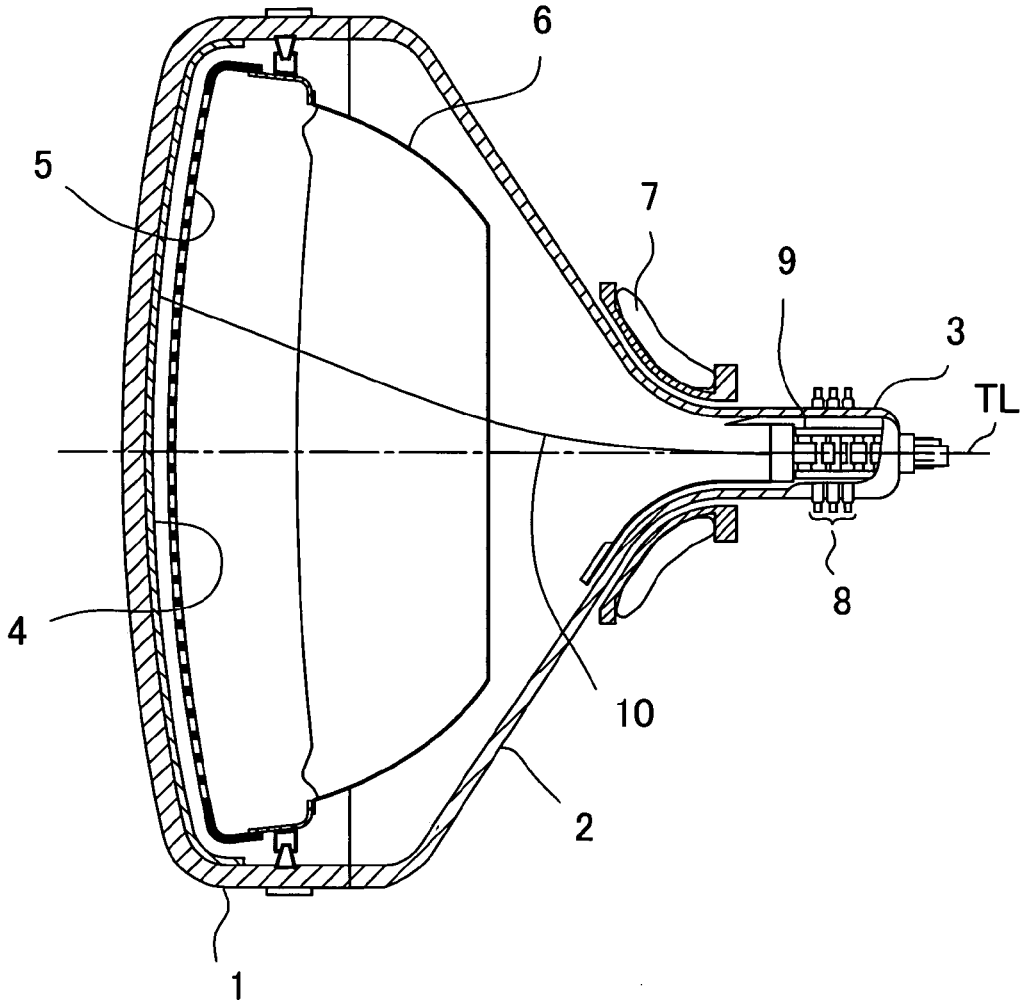
FIG. 1 is a schematic cross-sectional view for explaining the schematic structure of a shadow-mask-type color cathode ray tube for explaining one embodiment of a cathode ray tube according to the invention.

FIG. 1 is a schematic cross-sectional view for explaining the schematic structure of a shadow-mask-type color cathode ray tube which constitutes one embodiment of a cathode ray tube according to the invention. In FIG. 1, numeral 1 indicates a panel portion, numeral 2 indicates a funnel portion, numeral 3 indicates a neck portion, numeral 4 indicates a phosphor screen which is formed by applying phosphors to an inner surface of the panel portion, numeral 5 indicates a shadow mask which constitutes a color selecting electrode, and numeral 6 indicates a magnetic shield which blocks an external magnetic field (earth magnetism), wherein the magnetic shield 6 prevents a locus of an electron beam from being changed by the earth magnetism. Further, numeral 7 indicates a deflection yoke, numeral 8 indicates an external magnetism correction device, numeral 9 indicates an electron gun provided with indirectly heated cathodes which irradiates three electron beams, and numeral 10 indicates one of three electron beams as a representative. Further, symbol TL indicates a tube axis and the above-mentioned electron gun is arranged substantially coaxially with the tube axis TL.

An evacuated envelop which constitutes the cathode ray tube includes the panel portion having the phosphor screen on the inner surface thereof, the neck portion which accommodates the electron gun, and a funnel portion which connects the panel portion and the neck portion.

In such a shadow-mask-type color cathode ray tube, three electron beams 10 from the electron gun 9 are modulated in response to video signals form an external signal processing circuit not shown in the drawing and are irradiated toward the phosphor screen 4. Since the electron beams 10 pass through horizontal and vertical deflection magnetic fields generated by the deflection yoke 7 which is exteriorly mounted on a transitional region of the neck portion 3 and the funnel portion, the electron beams 10 are scanned two-dimensionally on the phosphor screen 4. The shadow mask 5 selects three electron beams which pass through a large number of apertures formed in the plain for respective colors thus reproducing a given image.

Figure 2:
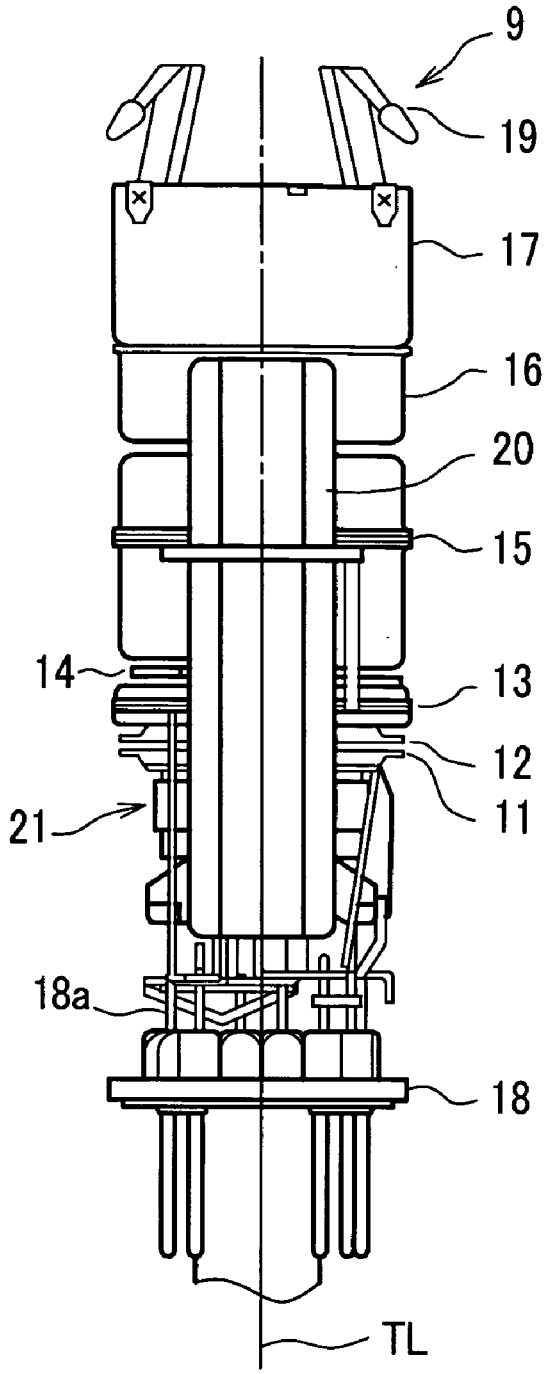
FIG. 2 is a side view for explaining a constitutional example of an electron gun used in the color cathode ray tube shown in FIG. 1.

FIG. 2 is a side view for explaining a constitutional example of the electron gun used in the color cathode ray tube of the invention shown in FIG. 1. In the electron gun 9, a control electrode (first grid electrode; G1) 11, an accelerating electrode (second grid electrode; G2) 12, focusing electrodes (third grid electrode; G3, a fourth grid electrode; G4, fifth grid electrode; G5) 13, 14, 15, an anode (sixth grid electrode; G6) 16 and a shield cup 17 are arranged at given intervals in the cube axis TL direction and under the given positional relationship, are fixedly supported on a multiform glass 20 and, at the same time, have tabs or lead lines formed on the respective electrodes welded to stem pins 18*a* formed on a stem 18.

Further, the electron gun 9 has the indirectly heated cathode structure 22 arranged close to the stem 18 side of the control electrode 11, and a heater having the constitution described later which heats the electron irradiation portion is incorporated in the indirectly heated cathode structure 22.

Here, numeral 19 indicates a bulb spacer contact which is resiliently brought into contact with an inner wall of the neck portion and has a function of aligning a center axis of the electron gun with a tube axis and a function of introducing an anode voltage to the electron gun from an inner conductive film applied to the inner wall of the funnel portion and the neck portion.

The control electrode 11, the accelerating electrode 12 and the indirectly heated cathode structure 21 constitute an electron beam generating portion (triode portion). Further, the focusing electrodes 13 to 15 accelerate and focus the electron beams irradiated from the electron beam generating portion and the electron beams are converged by a main lens formed between the focusing electrodes 15 and the anode 16 and are directed in the direction toward the phosphor screen.

The stem 18 is welded to an open end of the neck portion of the evacuated envelope and applies signals or voltages from the outside to the respective electrodes through stem pins 18*a*. Further, the exterior magnetism correction device (magnet assembly) 8 has a function of correcting the disagreement or the like between the electron beams and the phosphors attributed to a delicate axial displacement or a delicate rotational displacement between the electron gun 9 and the panel portion, the funnel portion and the shadow mask.

Figure 3:
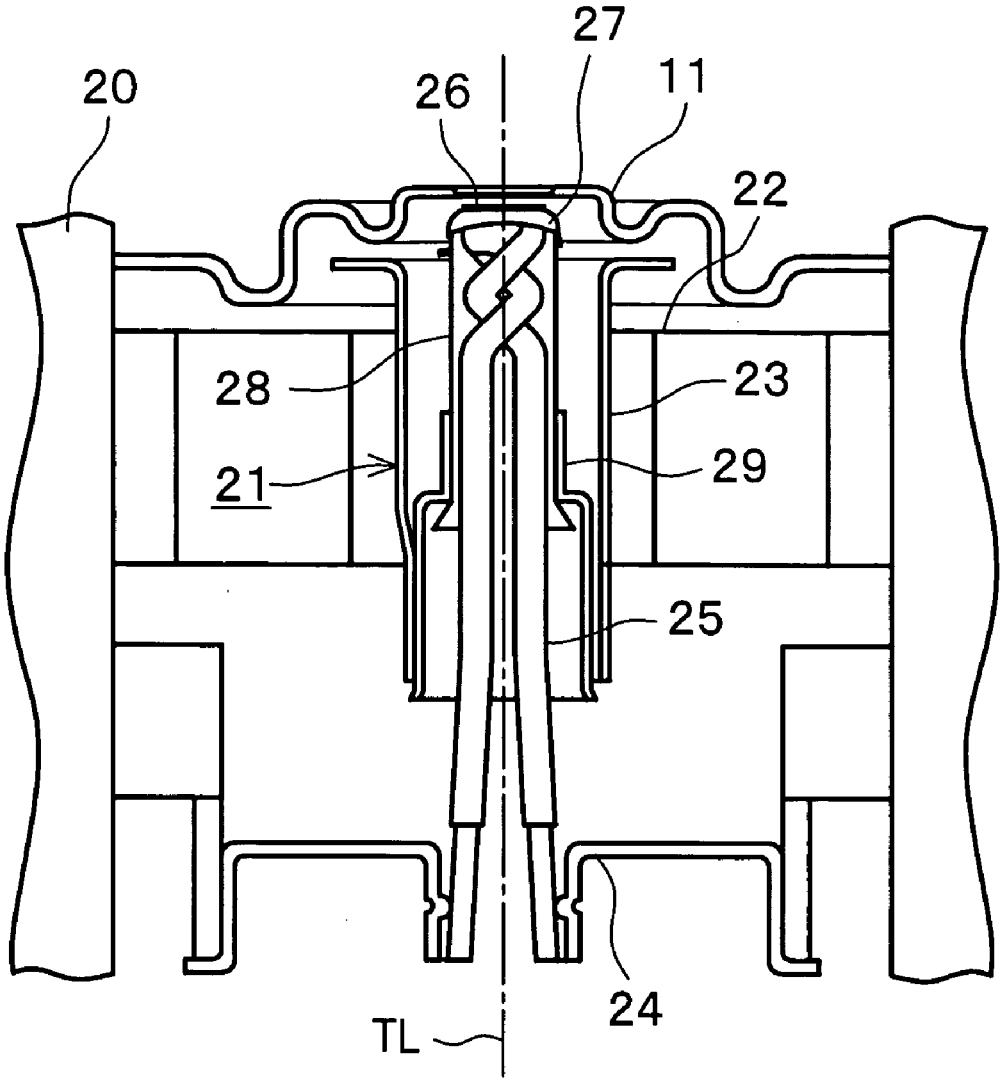
FIG. 3 is a cross-sectional view for explaining a constitutional example of an indirectly heated cathode structure shown in FIG. 1.

FIG. 3 is a cross-sectional view for explaining a constitutional example of the indirectly heated cathode structure shown in FIG. 2, wherein FIG. 3 shows the indirectly heated cathode structure which is arranged at the center of the in-line arrangement. The indirectly heated cathode structure 21 is constituted of a bead support 22, an eyelet 23, a heater support 24, a heater 25, a substrate metal 27 which holds an electron emission material layer 26, a cathode support sleeve 28 which supports the substrate metal 27, and a cathode disc 29, wherein the indirectly heated cathode structure 21 is fixed to a multiform glass 20 using the eyelet 23 and the bead support 22. Further, the cathode support sleeve includes a heater which is formed by winding the core-wire in a coil form in the inside thereof, and the heater 25 has the constitution described later and has an end portion (a welding portion) thereof fixed to the heater support 24 by welding.

Figure 4:
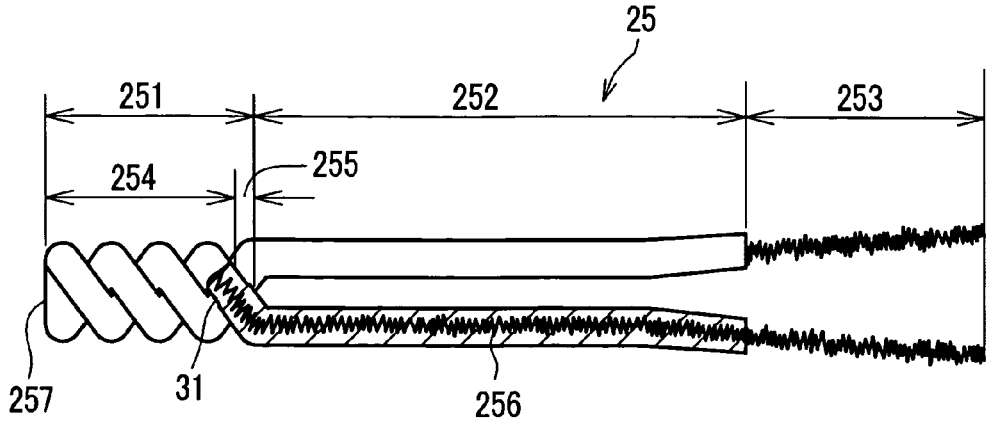
FIG. 4 is a side view with a part broken away of one embodiment of a heater used in the cathode ray tube according to the invention.
Figure 5:
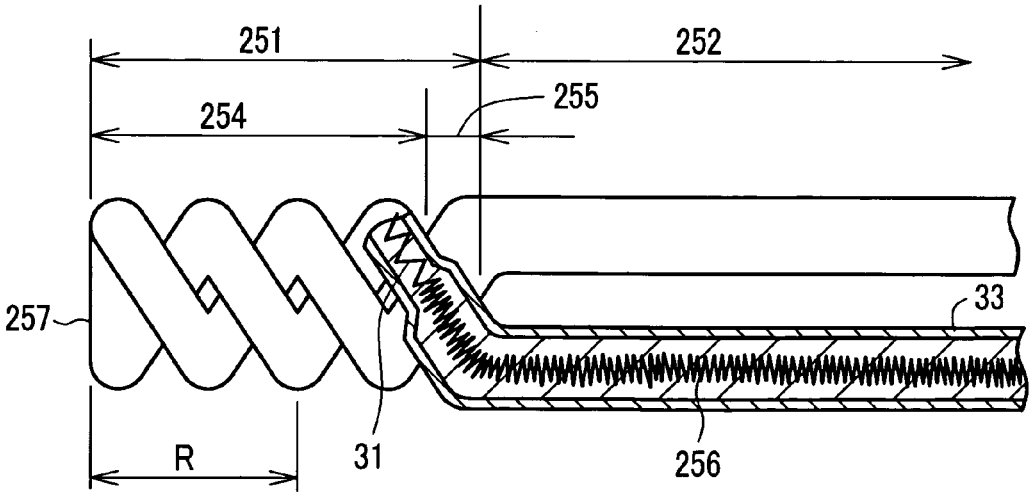
FIG. 5 is a side view with a part broken away showing an essential part of the heater shown in FIG. 4 in an enlarged manner.

FIG. 4 and FIG. 5 indicate an example of the heater used in the cathode ray tube according to the invention, wherein FIG. 4 is a side view with a part broken away of the heater and FIG. 5 is a cross-sectional view with a part broken away of an essential part in FIG. 4 in an enlarged manner. In the drawing, parts identical with the parts shown in the above-mentioned drawings are given same symbols. The heater includes a heat generating portion having the double helical structure which is formed by further twisting and winding the core-wires which are wound in a coil form, a leg portion which is contiguously formed with the heat generating portion and is wound in a coil form in a plurality of layers, and a welding portion which is contiguously formed with the leg portion and is welded to the heater support. Further, the heater is covered with an insulation film except for the welding portion. Still further, the heat generating portion includes regions which differ in the number of coil winding layers.

In FIG. 4 and FIG. 5, numeral 25 indicates the heater, numeral 251 indicates a heater generating portion of the heater 25, numeral 252 indicates the leg portion of the heater 25, numeral 253 indicates the welding portion of the heater 25, numeral 254 indicates a first winding portion of the heat generating portion 251, numeral 255 indicates a second winding portion of the heat generating portion 251, numeral 256 indicates a multi-layered winding portion of the leg portion 252, numeral 257 indicates a top portion of the heater 25, numeral 31 indicates a heat generating core-wire such as a tungsten line, for example, numeral 32 indicates an alumina insulation film, numeral 33 indicates a dark alumina coated film, and symbol R indicates a twisting and winding pitch of double helical structure of the heat generating portion 251.

A remaining portion of the coil winding having such a constitution except for the welding portion 253 is covered with the alumina insulation film 32 and, further, the dark alumina coated film 33 which contains tungsten fine powder is applied to a surface of the alumina insulation film 32 thus performing blackening treatment. The blackening treatment is performed for increasing the efficiency of the irradiation of the radiation heat from the heater so as to lower the temperature of the heater thus enhancing the reliability of the heater.

In the heater 25 shown in FIG. 4 and FIG. 5, the leg portion 252 and the welding portion 253 are constituted of the multi-layered winding portion 256 which is formed into the helical structure having the heat generating core-wire with a multiple coil winding such as a five-layered (five-wound) coil winding, for example, at a given pitch.

To the contrary, the heat generating portion 251 is constituted by joining the second winding portion 255 which has the multiple winding in the same manner as the above-mentioned leg portion 252 and the first winding portion 254 which is wound in a coil at a pitch finer than the winding pitch of the second winding portion 255 while adopting the single-layer helical structure, in a state that the second winding portion 255 is contiguously arranged on the above-mentioned leg-portion 252 side, and this joint body is twisted and wound to form a twisted and wound portion which is shaped in a double helical shape.

Figure 6:
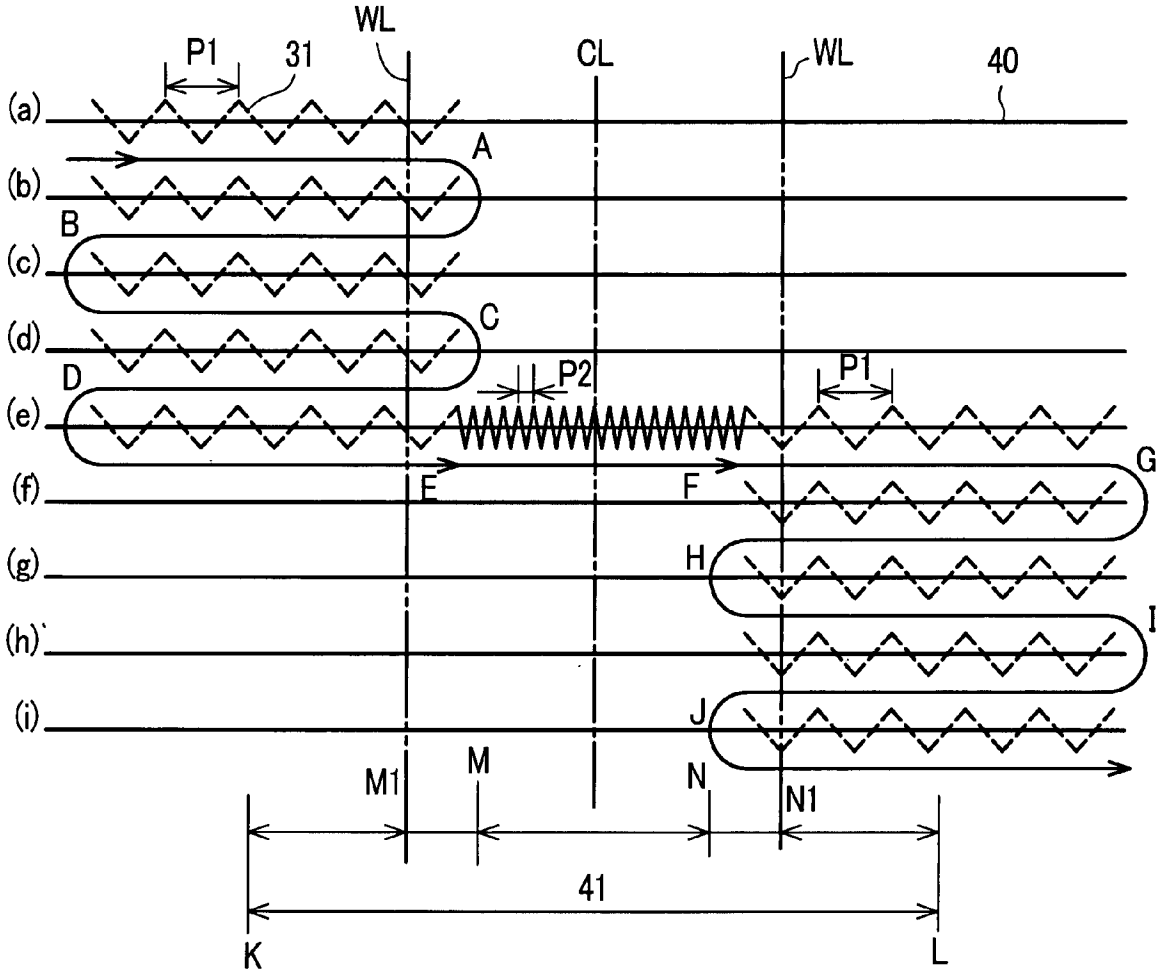
FIG. 6 is an explanatory view of a manufacturing method of the heater shown in FIG. 4.

The above-mentioned heater is explained in detail in conjunction with FIG. 6 which is an explanatory view of the manufacturing method of the heater.

(a) The tungsten line 31 is spirally wound as a coil on a molybdenum core-wire 40 in a normal direction from a starting point at a pitch P1 (for example, three turns/mm) until a point A.

(b) The tungsten line 31 is spirally wound on the molybdenum core-wire 40 as a coil at a pitch P1 while returning from a point A to a point B (in the reverse direction).

(c) The tungsten line 31 is again spirally wound on the molybdenum core-wire 40 as a coil at a pitch P1 in the normal direction from the point B to a point C.

(d) The tungsten line 31 is spirally wound on the molybdenum core-wire 40 as a coil at a pitch P1 from the point C to a point D in the reverse direction.

(e) The tungsten line 31 is further again spirally wound on the molybdenum core-wire 40 as a coil at a pitch P1 in the normal direction from the point D to a point E.

Up to the above-mentioned operations, one leg portion, the welding portion and a portion which forms a portion of the heat generating portion adopt the fivefold winding structure having the pitch P1.

Next, the tungsten line 31 is further spirally wound on the molybdenum core-wire 40 as a coil in the normal direction from the point E until a point F after getting over a folding center portion CL of the heater. From the point E to the point F, the single coil winding structure is adopted having a pitch P2. Here, the coil winding pitch P2 is set 15 turns/mm which is, for example, five times as large as the above-mentioned pitch P1. From the point F, the tungsten line 31 is further spirally wound on the molybdenum core-wire 40 as a coil in the normal direction until a point G at a pitch P1.

(f) The tungsten line 31 is spirally wound on the molybdenum core-wire 40 as a coil at a pitch P1 from the point G to a point H in the reverse direction.

(g) The tungsten line 31 is further again spirally wound on the molybdenum core-wire 40 as a coil at a pitch P1 in the normal direction from the point H to the point I.

(h) The tungsten line 31 is spirally wound on the molybdenum core-wire 40 as a coil at a pitch P1 from the point I to a point J in the reverse direction.

(i) The tungsten line 31 is further again spirally wound on the molybdenum core-wire 40 as a coil in the normal direction from the point J to the terminal end.

In the above-mentioned winding operation, a portion between the point F and the terminal end adopts the fivefold winding thus forming another leg portion, another welding portion and a portion of the heat generating portion.

As mentioned above, by cutting a product which is formed by winding the heat generating core-wire 31 on the molybdenum core-wire 40 as a coil at the point K and the point L, a helical coil 41 having a length of one heater is obtained.

The helical coil 41 forms a multiple-layered winding portion 256 which adopts the fivefold winding between the point K and a point M1 and between the point L and a point N1 respectively, forms a second winding portion 255 which adopts the same fivefold winding between the point M1 and the point M and between the point N1 and the point N respectively, and forms a first winding portion 254 which adopts a single-layer winding between the point M and the point N.

This helical coil 41 is folded at a folding center line CL and is twisted and wound until a twisting and winding line WL thus forming the heat generating portion 251 which is shaped in the double helical structure, and the leg portion 252 and the welding portion 253 are formed of the helical coil 41 outside the twisting and winding line WL.

The above-mentioned twisted and wound heat generating portion 251 forms the second winding portion 255 having the fivefold winding from the point M to the point M1 and from the point N to the point N1 and forms the first winding portion 254 having the single winding on a remaining portion thereof, that is, between the point M and the point N. By joining the second winding portion 255 and the first winding portion 254 and by twisting and winding the joint body thus constituting the twisting and winding portion which is shaped in the double helical structure.

Here, the respective sizes between the point M and the point M1 as well as between the point N and the point N1, as explained later in detail, are set within a range of 7% to 70% with respect to a winding pitch size R of the twisting and winding portion of the heat generating portion 251 from a practical viewpoint. It is more effective to set the respective sizes within a range of 7% to 60%. Further, it is still more effective to set the respective sizes within a range of 15% to 50%.

In this embodiment, the heater generating portion adopts the single coil winding at the first winding portion and the fivefold coil winding at the heater leg portion. However, it is possible to obtain the substantially same effect even when the heater generating portion has the twofold or more layers and the heater leg portions has layers twice or more as large as the layers of the heater generating portion.

Figure 7:
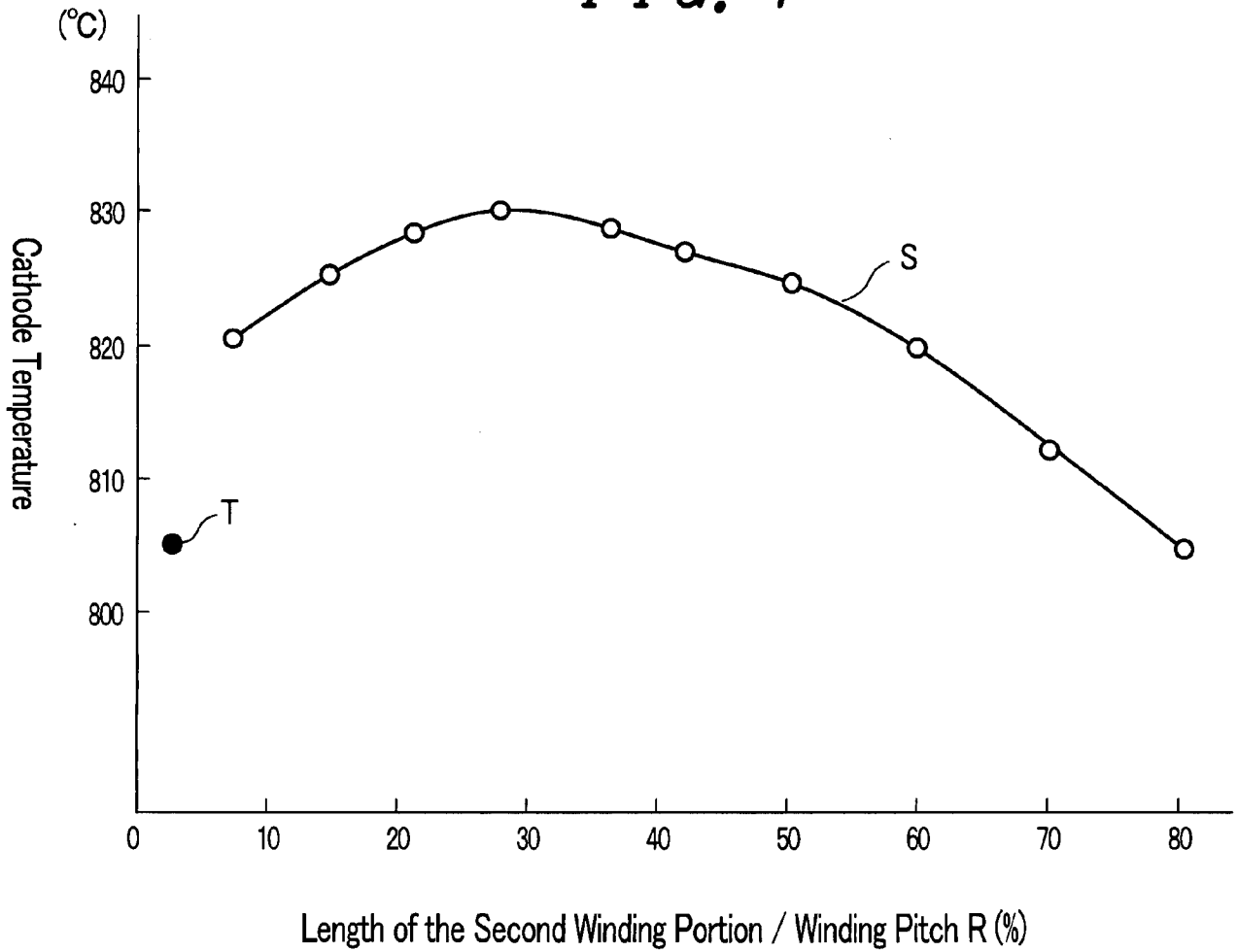
FIG. 7 is an explanatory view for explaining of the relationship between the constitution of a heat generating portion of the heater and a cathode temperature.

Next, FIG. 7 is an explanatory view for explaining of the relationship between the second winding portion 255 of the heat generating portion 251 of the heater used in the cathode ray tube of the invention and a cathode temperature. In FIG. 7, the cathode temperature of a side surface of the substrate metal 27 shown in FIG. 3 is taken on an axis of abscissas and a ratio of a length of the second winding portion 255 in the heat generating portion with respect to the twisting and winding pitch R of the double helical structure of the heat generating portion (1.4 mm in this embodiment) is taken on an axis of ordinates. Further, the heater voltage at the time of measuring is set to 110% of a rated value.

Figure 8:
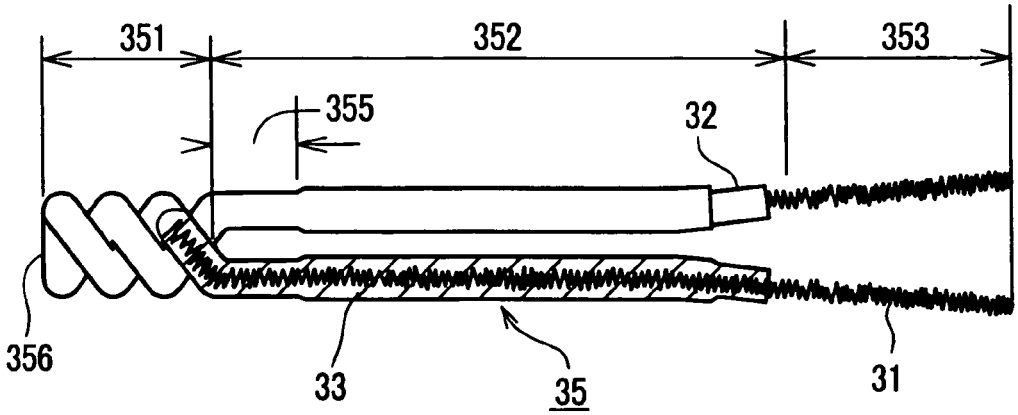
FIG. 8 PRIOR ART
FIG. 8 is a side view with a part broken away showing a conventional heater structure.
Figure 9:
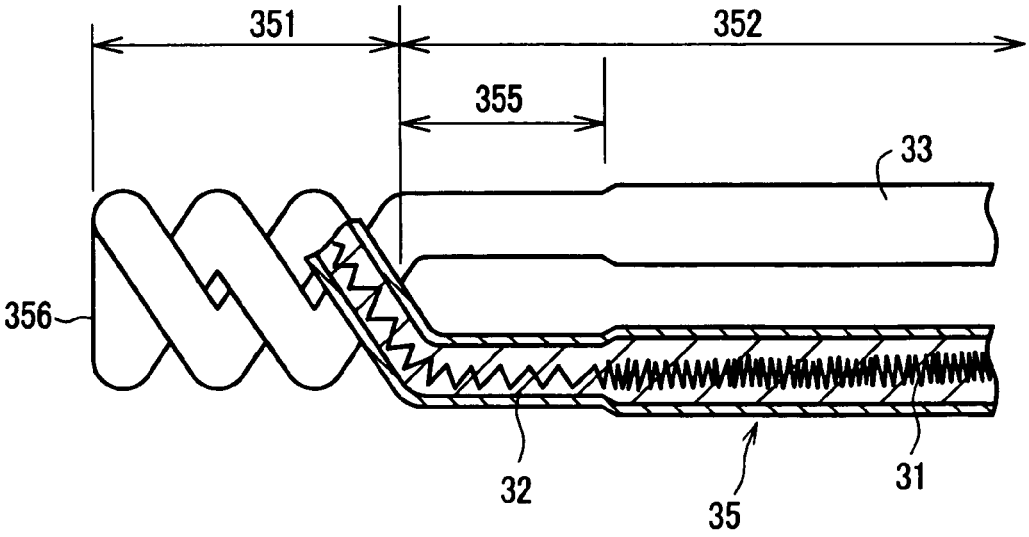
FIG. 9 PRIOR ART
FIG. 9 is a side view with a part broken away showing an essential part of the heater structure shown in FIG. 8 in an enlarged manner.

In FIG. 7, for a reference purpose, a black point T indicates a cathode temperature when the heater having the conventional structure as shown in FIG. 8 and FIG. 9 are used. An axis of abscissas for the black point T is not determined.

On the other hand, as indicated by a curve S, with respect to the heater used in the invention, by changing the relationship between the length of the second winding portion 255 in the heat generating portion 251 and the twisting and winding pitch R of the heat generating portion 251 to 7% to 70%, it is possible to elevate the cathode temperature by 15° C. to 25° C. Particularly, when the ratio assumes the value which falls within a range of 7% to 60%, it is possible to elevate the cathode temperature by 15° C. or more. Still further, when the ratio assumes the value which falls within a range of 15% to 50%, it is possible to further elevate the cathode temperature by 20° C. or more whereby the high temperature elevation becomes further apparent.

Accordingly, by specifying the relationship between the length of the second winding portion 255 in the heat generating portion 251 and the twisting and winding pitch R of the heat generating portion 251, it is possible to obtain the high temperature elevation of the cathode temperature whereby it is possible to ensure the desired electron irradiation characteristics.

As has been explained heretofore, according to the invention, by arranging the plural-layer winding portion having the coil winding specification similar to the coil winding specification of the leg portion at the portion of the heat generating portion of the heater which constitutes the cathode structure of the electron gun used in the cathode ray tube, it is possible to elevate the cathode temperature. Accordingly, it is possible to sufficiently cope with the lowering of the in-tube degree of vacuum which is brought about along with the rationalization of the cathode ray tube manufacturing steps and hence, it is possible to provide the cathode ray tube which exhibits the excellent electron irradiation characteristics.

What is claimed is:

1. A cathode ray tube including an evacuated envelope which is constituted of a panel portion having a phosphor screen on an inner surface thereof, a neck portion which accommodates an electron gun, and a funnel portion which connects the panel portion and the neck portion, wherein the electron gun includes an electron beam generating portion which is constituted of an indirectly heated cathode structure, a control electrode and an accelerating electrode and a main lens portion which is constituted of a focusing electrode and an anode electrode, the indirectly heated cathode structure includes an electron irradiation material layer, a substrate metal which holds the electron irradiation material layer and a cathode support sleeve which supports the substrate metal, wherein the cathode support sleeve includes a heater which is formed by winding a core-wire as a coil therein, the heater includes a heat generating portion having the double helical structure which is formed by further twisting and winding the core-wire which is wound as a coil, a leg portion which is contiguously formed with heat generating portion and is wound in a plurality of layers as a coil, and a welding portion which is contiguously formed with the leg portion and is welded to a heater support, the heater has a portion thereof except for the welding portion thereof covered with an insulation film, and the heat generating portion has regions which differ in the number of coil winding layers.

2. A cathode ray tube according to claim 1, wherein the heat generating portion sets the number of coil winding layers on a leg portion side larger than the number of coil winding layers on a substrate metal side.

3. A cathode ray tube according to claim 2, wherein the heat generating portion sets the number of coil winding layers on the leg portion side twice or more as large as the number of coil winding layers on the substrate metal side.

4. A cathode ray tube according to claim 1, wherein a length of the coil winding portion of the heat generating portion on the leg portion side in the direction parallel to a tube axis is set to a value which falls within a range of 7% to 70% of a pitch of the twisting and winding portion of the heat generating portion.

5. A cathode ray tube according to claim 4, wherein a length of the coil winding portion of the heat generating portion on the leg portion side in the direction parallel to a tube axis is set to a value which falls within a range of 7% to 60% of a pitch of the twisting and winding portion of the heat generating portion.

6. A cathode ray tube according to claim 5, wherein a length of the coil winding portion of the heat generating portion on the leg portion side in the direction parallel to a tube axis is set to a value which falls within a range of 15% to 50% of a pitch of the twisting and winding portion of the heat generating portion.

* * * * *